United States Patent [19]

Elledge

[11] Patent Number: 4,524,033

[45] Date of Patent: Jun. 18, 1985

[54] MULTIPLE FUEL CARBURETOR

[76] Inventor: Jefferson D. Elledge, 8060 Northcrest Dr., Jonesboro, Ga. 30236

[21] Appl. No.: 480,796

[22] Filed: Mar. 31, 1983

[51] Int. Cl.[3] ..... F02M 1/16

[52] U.S. Cl. ..... 261/18 B; 123/575; 261/27

[58] Field of Search ..... 261/18 B, 27; 123/575

[56] References Cited

U.S. PATENT DOCUMENTS

| | | | |
|---|---|---|---|
| 923,093 | 5/1909 | Wegner | 261/18 B |
| 1,240,080 | 9/1917 | Morse, Jr. et al. | 261/18 B |
| 1,730,990 | 10/1929 | Barnhart | 123/575 |
| 2,163,241 | 6/1939 | Huber | 261/18 B |
| 2,406,913 | 9/1946 | Serrano | 261/18 B |
| 2,647,735 | 8/1953 | Haynie | 261/18 B |
| 2,930,432 | 3/1960 | Engstrom | 123/575 |
| 3,014,474 | 12/1961 | Banker | 123/575 |
| 3,271,014 | 9/1966 | Wu | 261/43 |
| 4,117,810 | 10/1978 | John | 261/18 B |
| 4,128,088 | 12/1978 | Hermann | 261/39 A |

FOREIGN PATENT DOCUMENTS

| | | | |
|---|---|---|---|
| 703113 | 1/1954 | United Kingdom | 261/18 B |

*Primary Examiner*—Tim Miles

[57] ABSTRACT

An internal combustion engine carburetor is provided with a means of remotely changing the delivery of fuel and the metering apparatus of said carburetor so that either of two (2) different liquid fuels having different air to fuel stoichiometric ratios may be used in the same carburetor/engine assembly.

Two (2) different metering rates are accomplished by changing the available flow areas of the fuel metering jets or orifices by means of an electric solenoid operated mechanism.

A switch on the dash operating the solenoids, fuel selection, and fuel delivery for the chosen fuel allows the driver to select fuels at the proper combustion mixture.

2 Claims, 9 Drawing Figures

MULTIPLE FUEL CARBURETOR

BACKGROUND AND SUMMARY

Dual fuel carburetion systems have been introduced and tested previously with two goals in mind—one involving antidetonant fuels for high compression use and the other using a supplemental fuel to lessen consumption of gasoline for economic reasons. The field of this invention lies in the economic class.

At this time many non-petroleum fuels are being developed for use with internal combustion engines. Their marketability is limited because changes in carburetion to use them render a carburetor-engine assembly unable to operate on gasoline. This is not a problem except for the limited supply or geographic location of the non-petroleum fuels at this time. This limits conversions to special purpose vehicles, trucks with large tanks or vehicles with known itineraries and range. The convenience is gone. With limited market for non-petroleum fuels because of few conversions, the supply and location of these fuels will not grow as fast as it could.

A carburetor and fuel delivery system with a method of remotely changing fuel delivery and metering so that an engine could operate solely and correctly on either of two fuels could help alleviate this problem. The remote actuator is in the form of an electric switch on the dash of the vehicle, requiring no expertise in carburetion or mechanical fields to quickly switch operation from one fuel to another.

Also, some liquid fuels do not have high vapor pressures and low heat of vaporization, like gasoline, making cold starts and cold drive-away difficult. A vehicle could easily be started and driven away in very cold weather on gasoline and switched to the other fuel when the motor warmed.

DRAWINGS

Figure 1:
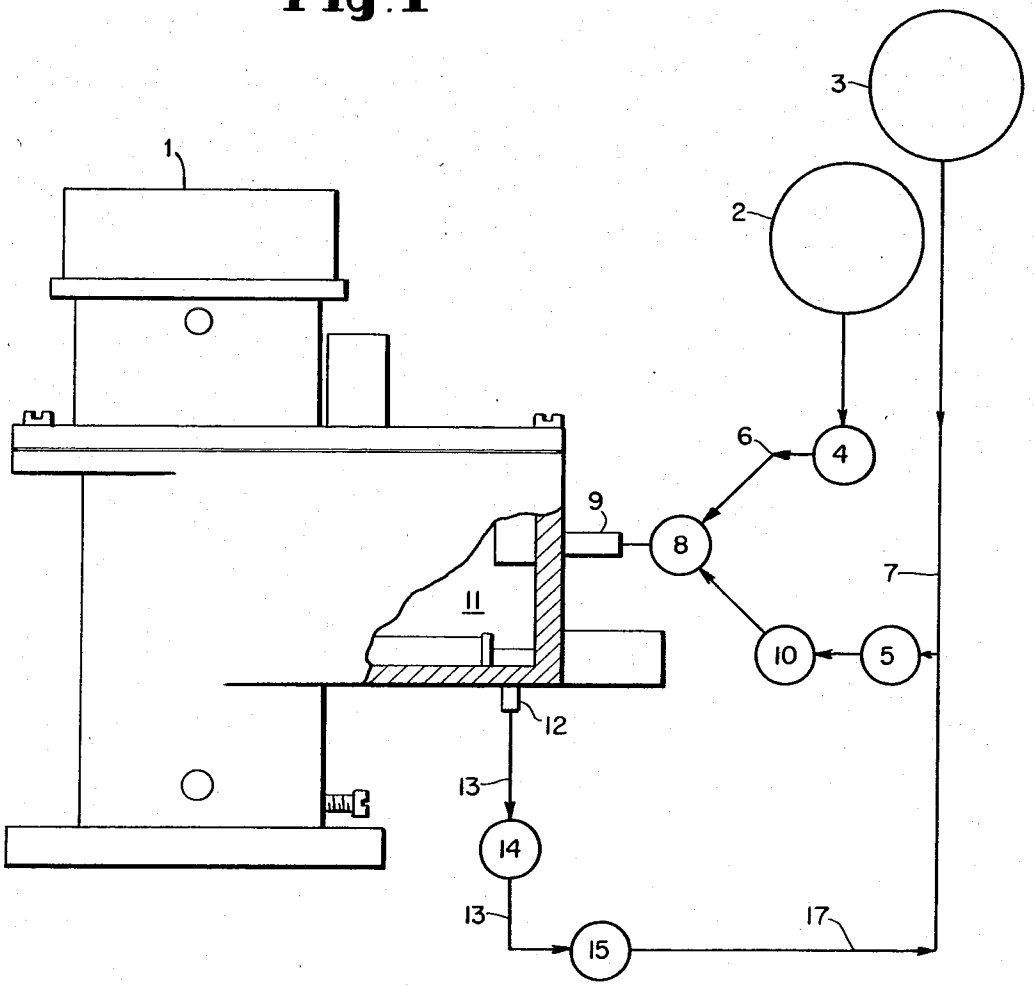

FIG. 1 Schematic of fuel delivery and selection system. Carburetor represented is a one-bbl type with metering rod/main jet assembly (see FIG. 3).

Figure 2:
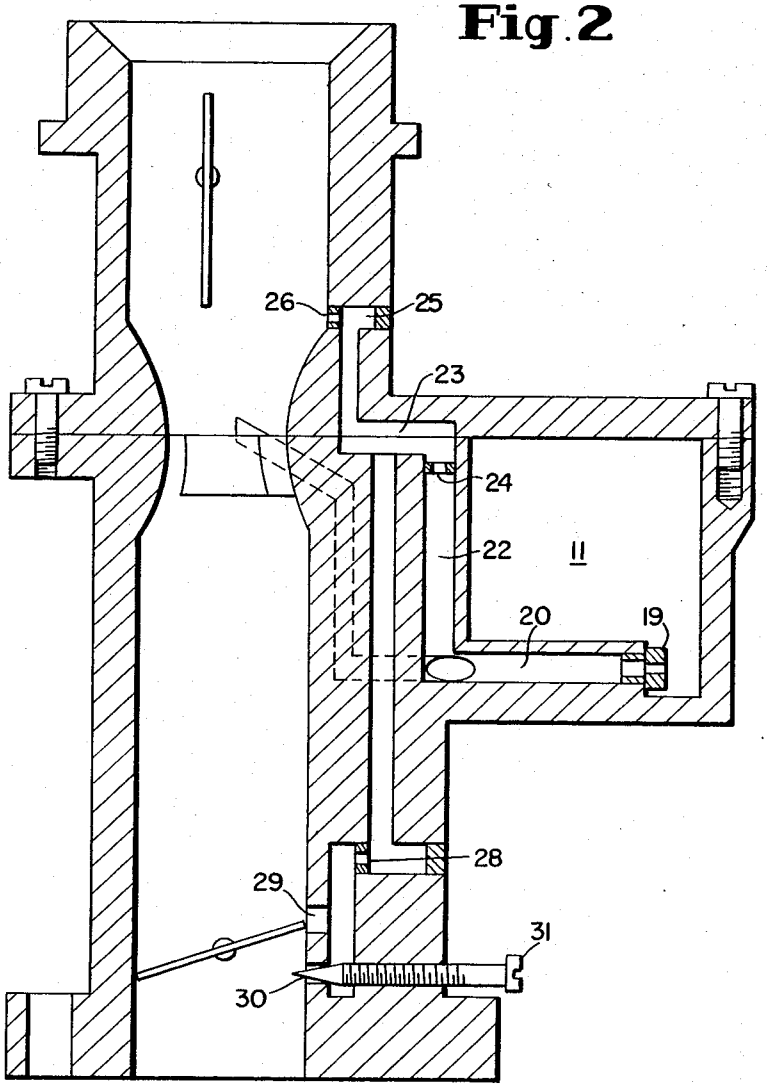

FIG. 2 Section view of idle and power system in a simplified one-bbl carburetor. Fuel inlet, float valve and load-enrichment systems have been omitted for clarity.

Figure 3:
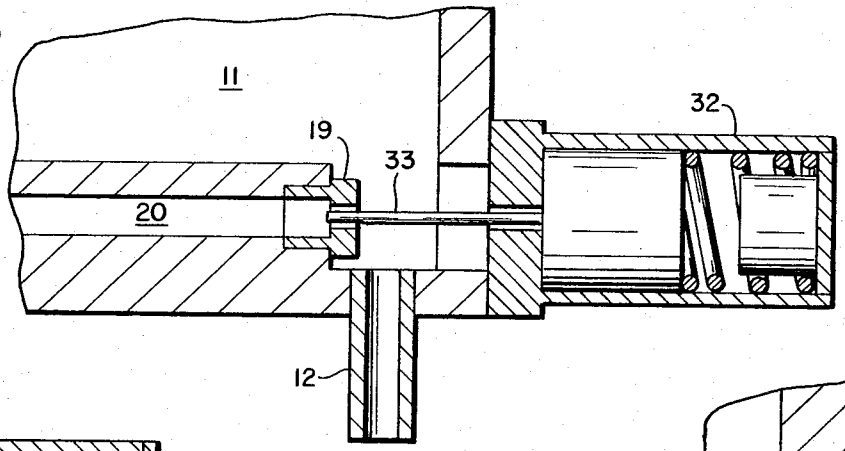

FIG. 3 Partial section view of main jet/metering rod arrangement.

Figure 4:
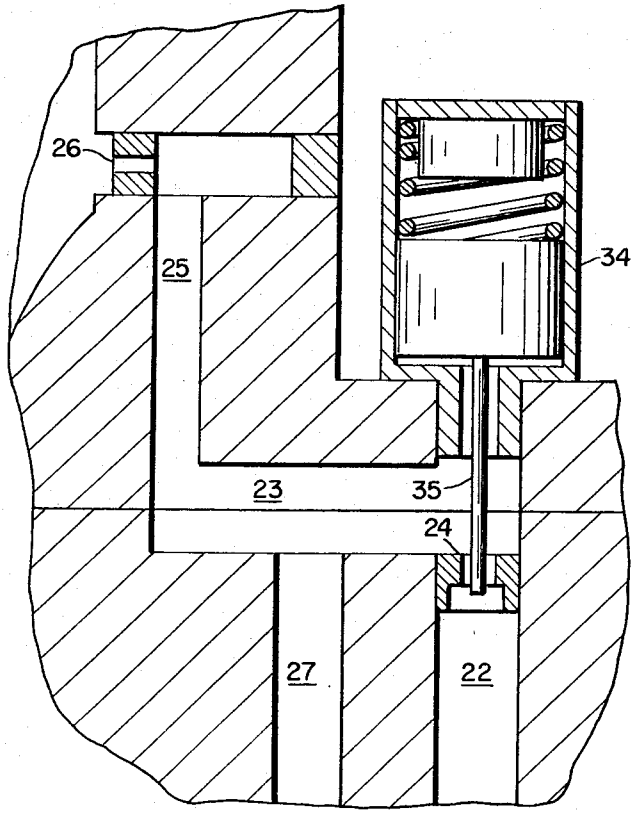

FIG. 4 Partial sectión view of idle system using idle fuel jet/metering rod assembly to change idle mixture metering.

Figure 5:
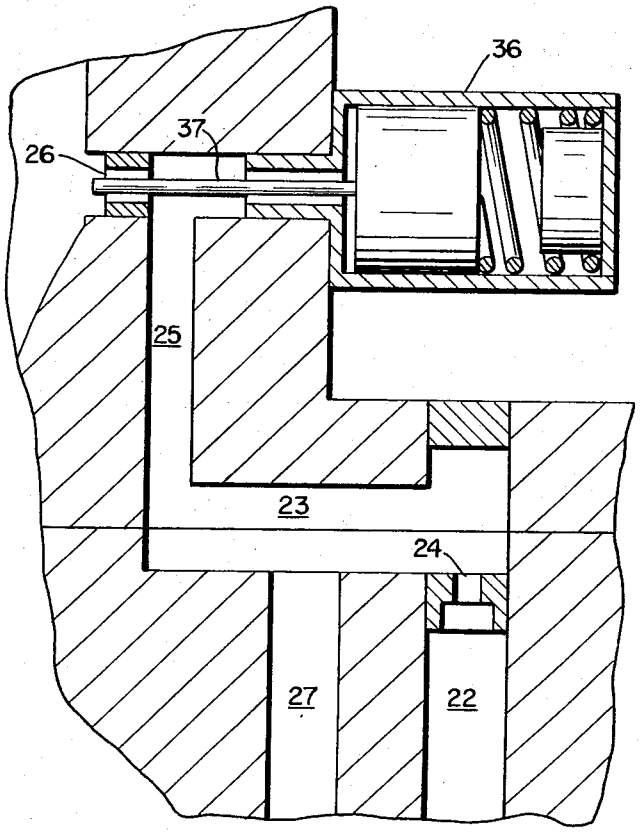

FIG. 5 Partial section view of idle system using idle air bleed/metering rod arrangement to change idle mixture metering.

Figure 6:
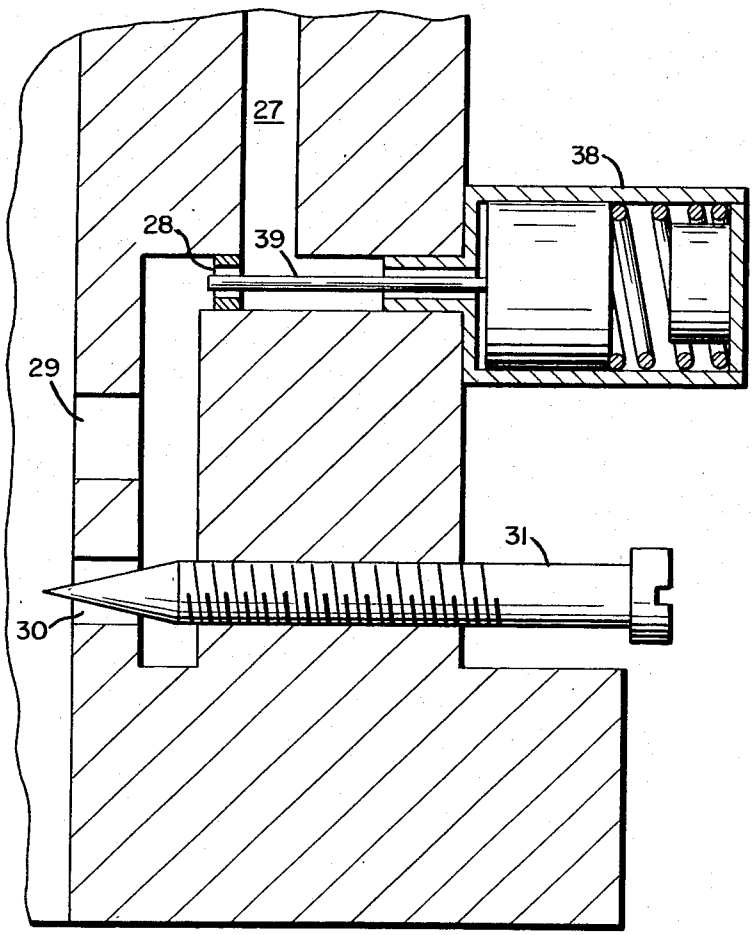

FIG. 6 Partial section view of idle system using idle restriction/metering rod arrangement to change idle mixture metering.

Figure 7:
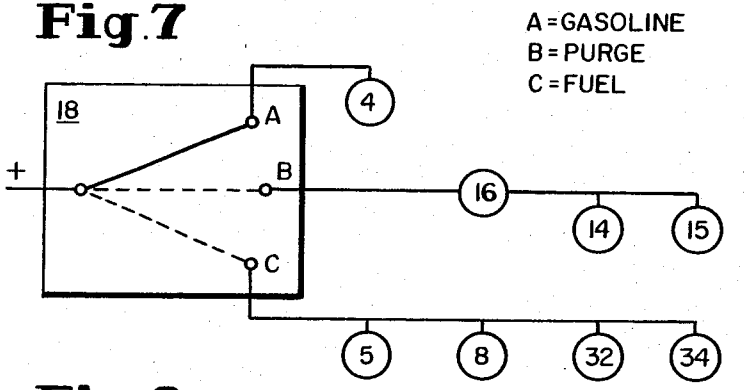
Figure 8:
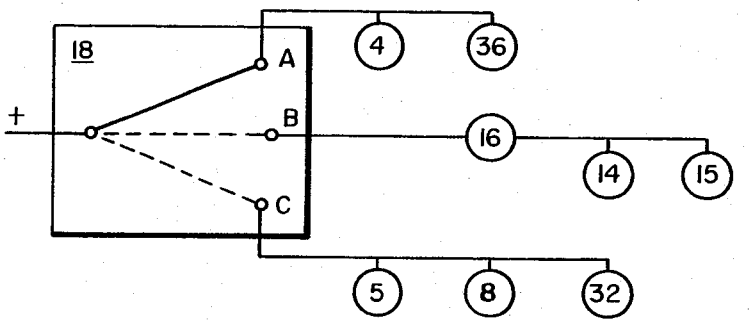
Figure 9:
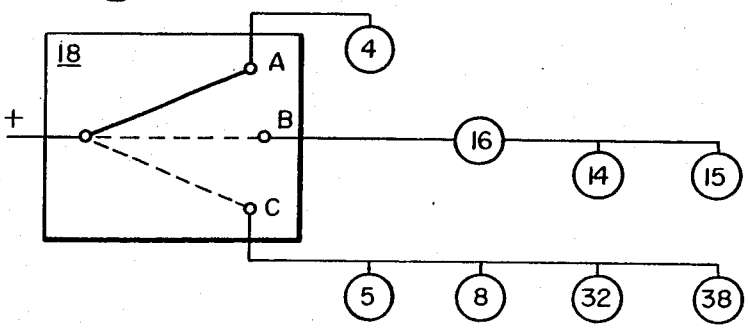

FIGS. 7, 8, 9 Electrical Schematics.

DESCRIPTION

FUEL DELIVERY

FIG. 1. The carburetor (1) is supplied with gasoline or a liquid motor fuel other than gasoline hereafter called fuel from one or the other of two separate tanks (2,3). A standard electric fuel pump (4,5) is located at or in each tank. One tank (2) is for gasoline, hereafter called the gas tank. The other tank (3) is for a liquid motor fuel other than gasoline, hereafter called the fuel tank. The gasoline delivery line (6) runs from the pump at the gas tank to an electrically operated selector valve (8) normaly open from the gas line to the carburetor inlet located at the inlet to the carburetor float bowl (9). The fuel delivery line (7) runs from the pump at the fuel tank through a heat exchanger (10) heated by the motor's coolant to the selector valve. A dash mounted three position switch (18) is wired so that one throw operates the gasoline pump, the opposite throw switches the selector valve from the gas line to the fuel line and operates the fuel pump and the center throw supplies current to the fuel purge button.

If the carburetor/engine assembly is cold and has last been operated on a fuel (not gasoline) that has a high heat of varporization requirement, that fuel must be drained (purged) from the carburetor's float bowl (11) and replaced with gasoline for an easy start and smooth drive-off.

A drain tube (12) is installed in the lowest part of the carburetor's float bowl. A drain line (13) runs from this tube through a flow stop solenoid valve (14), normally closed, to a small centrifugal type fluid pump (15). The flow stop solenoid is opened and said pump operated by a normaly open push button type switch (16) on the dash (purge button). The outlet of said pump is connected by a flexible hose (17) to a tee junction with the fuel (not gasoline) line. When the dash switch is in the center or purge position and the purge button is pushed, fuel in the float bowl is pumped out of the bowl and back into the fuel tank by way of the fuel line (7). The dash switch is then set for gasoline, filling the carburetor with gas. If the engine is warm, a start on either fuel is satisfactory.

DESCRIPTION

METERING METHODS

FIG. 2. In a constant venturi downdraft carburetor with typical fuel bowl (11) and standard float valve for maintaining a constant fuel level, a main jet (19) is situated in the bottom of the fuel bowl so that it is easily accessible. A fuel passage (20) from the main jet ends in a nozzle located in the venturi (21). The idle system is shown as comprising a well (22) extending upwardly from the lower end of the main fuel passage and terminating at its upper end in a cross passage (23). An idle fuel jet (24) is located in the upper end of this passage. An idle air bleed passage (25) extends upwardly from the other end of the cross passage to the air horn of the carburetor above the venturi and below the choke. The idle air bleed jet (26) is located in the air horn end of this passage. An idle mixture passage (27) extends down from the cross passage through an idle mixture restriction (28) to the off-idle port (29) and then to the idle port (30). The idle port has a typical needle valve configuration (31).

FIG. 3. The main jet (19) is sized for operation on a fuel requiring more liquid fuel per unit of air than gasoline requires. A solenoid (32) is positioned to insert or retract a uniform diameter metering rod (33) into or out of the main jet orifice to give two separate available orifice areas. The metering rod is sized so that the available orifice area remaining with said rod inserted in the jet is correct for gasoline operation.

The most critical area in two fuel carburetion is the idle and off-idle metering system. For good stop and go operation and proper idle, the idle air and fuel mixture must be within close limits. A change in air (26) or fuel jets (24) must not result in slow idle system response. Off-idle lag (hesitation) may be caused by too lean an idle mixture or too slow a response from the off-idle port (29). Also, if idle mixture is correct on either fuel, there seems to be no need to adjust the idle mixture screw (31).

The idle mixture may be changed by one of these methods:

FIGS. 4, 7. A solenoid (34) is positioned to insert or retract a uniform diameter metering rod (35) into or out of the idle mixture fuel metering jet orifice (24) to give two separate available orifice areas. Said jet is sized to correctly meter fuel to the idle system ("fuel" hereafter being the same liquid that the main jet is sized for). Said metering rod is sized so that insertion in said jet decreases the available orifice area to a size correct for gasoline. On many carburetor designs it is impossible to use this method because of the location and small size of the idle mixture fuel metering jet.

FIGS. 5, 8. A solenoid (36) is positioned to insert or retract a uniform diameter metering rod (37) into or out of the idle mixture air bleed (26) to give two separate available orifice areas. Said air bleed is sized to correctly meter air to the idle system when the carburetor is operated on gasoline. The metering rod for this assembly is sized so that insertion of the rod in the air bleed orifice decreases the air bleed to a correct size for fuel.

FIGS. 6, 9. A solenoid (38) is positioned to insert or retract a uniform diameter metering rod (39) into or out of the idle mixture restriction (28) to give two separate restriction areas. The idle mixture restriction is sized for correct operation on fuel. The metering rod for this assembly is sized so that insertion of the rod into the idle restriction deacreases the restriction area that the idle mixture must pass through to get to the off-idle port and/or idle port to a size correct for operation on gasoline.

All solenoids are spring loaded as to be normally inserted in their respective orifices. When a solenoid is energized it withdraws its metering rod completely from its respective orifice. See electrical schematic for operation of main/idle combinations.

I claim:

1. A dual fuel supply system for internal combustion engines comprising a first tank adapted to contain gasoline and a second tank adapted to contain a second fuel, first and second fuel pumps connected to said first and second tanks respectively and adapted to supply fuel to electrically operated selector valve means controlling the discharge of fuel into a carburetor float bowl, electrical switch means adapted to be manually operated to selectively energized alternate of said pumps and simultaneously move said selector valve means to either a first position transmitting fuel from said first pump or to a second position transmitting fuel from said second pump, said fuel bowl having a drain tube therein, said drain tube including a normally closed solenoid valve and a normally inactive electric fuel pump and discharging into said second fuel tank, and electric switch means adapted to energize said drain-line solenoid valve and pump to empty said bowl.

2. A dual fuel supply system for internal combustion engines comprising a first tank adapted to contain gasoline and a second tank adapted to contain a second fuel, means to alternately supply fuel from said tanks to a carburetor float bowl, including electrically operated selector valve means controlling flow therebetween, manually operated electrical switch means operatively connected to said selector valve means and adapted to move said means to either a first position transmitting fuel from said first tank or to a second position transmitting fuel from said second tank, said carburetor comprising orifice means controlling the flow of fuel through main and idle circuits and the flow of bleed air, solenoid-controlled flow regulator means comprising constant diameter metering rod means adapted to move into at least one of said orifice means to control flow therethrough, and means operatively connecting said flow regulator means with said electrical switch means.

* * * * *